US006476308B1

(12) United States Patent
Zhang

(10) Patent No.: US 6,476,308 B1
(45) Date of Patent: Nov. 5, 2002

(54) METHOD AND APPARATUS FOR CLASSIFYING A MUSICAL PIECE CONTAINING PLURAL NOTES

(75) Inventor: Tong Zhang, Mountain View, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/931,026

(22) Filed: Aug. 17, 2001

(51) Int. Cl.[7] ..... G10H 7/00
(52) U.S. Cl. ..... 84/616; 84/623; 84/600
(58) Field of Search ..... 84/600, 601, 615, 84/616, 623, 629

(56) References Cited

U.S. PATENT DOCUMENTS 6,185,527 B1 * 2/2001 Petkovic et al. ..... 704/231
6,201,176 B1 * 3/2001 Yourlo ..... 434/307 A

OTHER PUBLICATIONS

"Rough Sets As A Tool For Audio Signal Classification" by Alicja Wieczorkowska of the Technical University of Gdansk, Poland, pp. 367–375.

"Computer Identification of Musical Instruments Using Pattern Recognition With Cepstral Coefficients As Features", by Judith C. Brown, J. Acoust. Soc. Am 105 (3) Mar. 1999, pp. 1933–1941.

"Musical Timbre Recognition With Neural Networks" by Jeong, Jae–Hoon et al, Department of Electrical Engineering, Korea Advanced Institute of Science and Technology, pp. 869–872.

"Auditory Modeling and Self–Organizing Neural Network for Timbre Classification" by Cosi, Piero et al., Journal of New Music Research, vol. 23 (1994), pp. 71–98.

"Timbre Recognition of Single Notes Using An ARTMAP Neural Network" by Fragoulis, D.K. et al, National Technical University of Athens, ICECS 1999 (IEEE International Conference on Electronics, Circuits and Systems), pp. 1009–1012.

"Recognition of Musical Instruments By A NonExclusive Neuro–Fuzzy Classifier" by Constantini, G. et al, ECMCS '99, EURASIP Conference, Jun. 24–26, 1999, Kraków, 4 pages.

"Spectral Envelope Modeling" by Kristoffer Jensen, Department of Computer Science, University of Copenhagen, Denmark, Aug. 1998, pp. 1–7.

N. Mohanty, "Random signals estimation and indentification—Analysis and Applications", Van Nostrand Reinhold Company, 1986, Chpt. 4, pp. 319–343.

"An Introduction To Neural Networks", by K. Gurney, UCL Press, 1997, Chpt. 6, pp. 65–129.

"Robust Text–Independent Speaker Identification Using Gaussian Mixture Models", by D. Reynolds and R. Rose, IEEE Transactions On Speech and Audio Processing, vol. 3, No. 1, pp. 72–83, 1985.

* cited by examiner

*Primary Examiner*—Jeffrey Donels

(57) ABSTRACT

The present invention is directed to classifying a musical piece based on determined characteristics for each of plural notes contained within the piece. Exemplary embodiments accommodate the fact that in a continuous piece of music, the starting and ending points of a note may overlap previous notes, the next note, or notes played in parallel by one or more instruments. This is complicated by the additional fact that different instruments produce notes with dramatically different characteristics. For example, notes with a sustaining stage, such as those produced by a trumpet or flute, possess high energy in the middle of the sustaining stage, while notes without a sustaining stage, such as those produced by a piano or guitar, posses high energy in the attacking stage when the note is first produced. Exemplary embodiments address these complexities to permit the indexing and retrieval of musical pieces in real time, in a database, thus simplifying database management and enhancing the ability to search multimedia assets contained in the database.

22 Claims, 8 Drawing Sheets

METHOD AND APPARATUS FOR CLASSIFYING A MUSICAL PIECE CONTAINING PLURAL NOTES

BACKGROUND OF THE INVENTION

1. Field of the Invention

The present invention relates generally to classification of a musical piece containing plural notes, and in particular, to classification of a musical piece for indexing and retrieval during management of a database.

2. Background Information

Known research has been directed to the electronic synthesis of individual musical notes, such as the production of synthesized notes for producing electronic music. Research has also been directed to the analysis of individual notes produced by musical instruments (i.e., both electronic and acoustic). The research in these areas has been directed to the classification and/or production of single notes as monophonic sound (i.e., sound from a single instrument, produced one note at a time) or as synthetic (e.g., MIDI) music.

Known techniques for the production and/or classification of single notes have involved the development of feature extraction methods and classification tools which can be used with respect to single notes. For example, a document entitled "Rough Sets As A Tool For Audio Signal Classification" by Alicja Wieczorkowska of the Technical University of Gdansk, Poland, pages 367–375, is directed to automatic classification of musical instrument sounds. A document entitled "Computer Identification of Musical Instruments Using Pattern Recognition With Cepstral Coefficients As Features", by Judith C. Brown, J. Acoust. Soc. Am 105 (3) Mar. 1999, pages 1933–1941, describes using cepstral coefficients as features in a pattern analysis.

It is also known to use wavelet coefficients and auditory modeling parameters of individual notes as features for classification. See, for example, "Musical Timbre Recognition With Neural Networks" by Jeong, Jae-Hoon et al, Department of Electrical Engineering, Korea Advanced Institute of Science and Technology, pages 869–872 and "Auditory Modeling and Self-Organizing Neural Networks for Timbre Classification" by Cosi, Piero et al., Journal of New Music Research, Vol. 23 (1994), pages 71–98, respectively. These latter two documents, along with a document entitled "Timbre Recognition of Single Notes Using An ARTMAP Neural Network" by Fragoulis, D. K. et al, National Technical University of Athens, ICECS 1999 (IEEE International Conference on Electronics, Circuits and Systems), pages 1009–1012 and "Recognition of Musical Instruments By A NonExclusive Neuro-Fuzzy Classifier" by Costantini, G. et al, ECMCS '99, EURASIP Conference, Jun. 24–26, 1999, Kraków, 4 pages, are also directed to use of artificial neural networks in classification tools. An additional document entitled "Spectral Envelope Modeling" by Kristoffer Jensen, Department of Computer Science, University of Copenhagen, Denmark, describes analyzing the spectral envelope of typical musical sounds.

Known research has not been directed to the analysis of continuous music pieces which contain multiple notes and/or polyphonic music produced by multiple instruments and/or multiple notes played at a single time. In addition, known analysis tools are complex, and unsuited to real-time applications such as the indexing and retrieval of musical pieces during database management.

SUMMARY OF THE INVENTION

The present invention is directed to classifying a musical piece based on determined characteristics for each of plural notes contained within the piece. Exemplary embodiments accommodate the fact that in a continuous piece of music, the starting and ending points of a note may overlap previous notes, the next note, or notes played in parallel by one or more instruments. This is complicated by the additional fact that different instruments produce notes with dramatically different characteristics. For example, notes with a sustaining stage, such as those produced by a trumpet or flute, possess high energy in the middle of the sustaining stage, while notes without a sustaining stage, such as those produced by a piano or guitar, posses high energy in the attacking stage when the note is first produced. Exemplary embodiments address these complexities to permit the indexing and retrieval of musical pieces in real time, in a database, thus simplifying database management and enhancing the ability to search multimedia assets contained in the database.

Generally speaking, exemplary embodiments are directed to a method of classifying a musical piece constituted by a collection of sounds, comprising the steps of detecting an onset of each of plural notes contained in a portion of the musical piece using a temporal energy envelope; determining characteristics for each of the plural notes; and classifying a musical piece for storage in a database based on integration of determined characteristics for each of the plural notes.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE INVENTION

Figure 1:
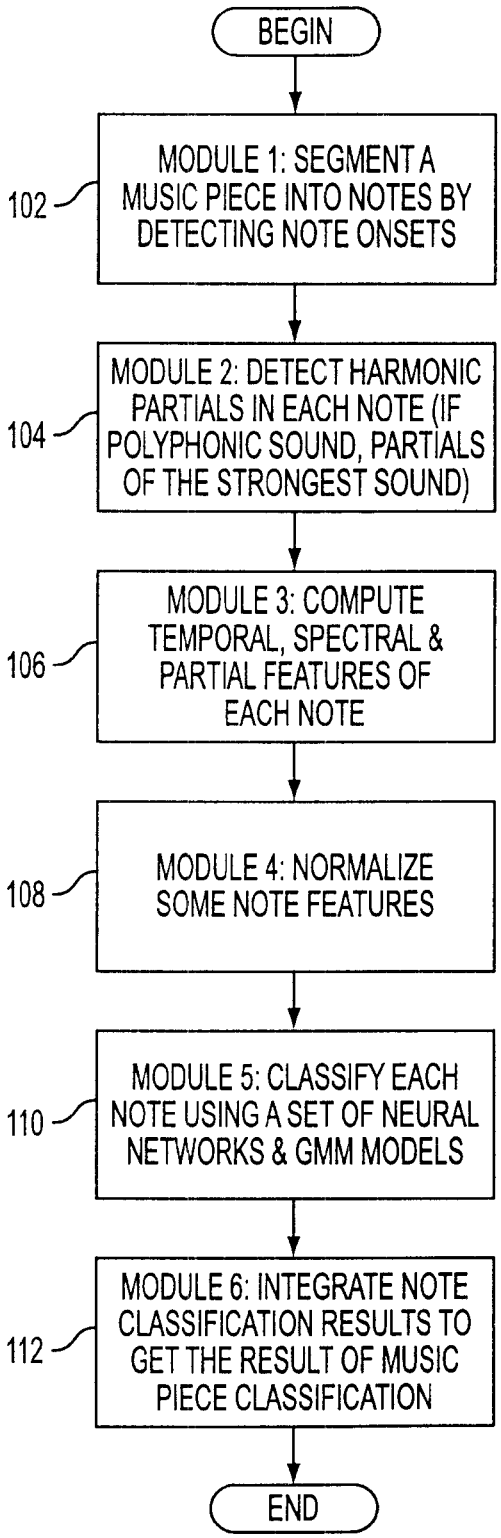
FIG. 1 shows an exemplary functional block diagram of a system for classifying a musical piece in accordance with an exemplary embodiment of the present invention.

The FIG. 1 system implements a method for classifying a musical piece constituted by a collection of sounds, which includes a step of detecting an onset of each of plural notes in a portion of the musical piece using a temporal energy envelope. For example, module 102 involves segmenting a musical piece into notes by detecting note onsets.

The FIG. 1 system further includes a module 104 for determining characteristics for each of the plural notes whose onset has been detected. The determined characteristics can include detecting harmonic partials in each note. For example, in the case of polyphonic sound, partials of the strongest sound can be identified. The step of determining characteristics for each note can include computing temporal, spectral and partial features of each note as represented by module 106, and note features can be optionally normalized in module 108.

The FIG. 1 system also includes one or more modules for classifying the musical piece for storage in a database based on integration of the determined characteristics for each of the plural notes. For example, as represented by module 110 of FIG. 1, each note can be classified using a set of neural networks and Gaussian mixture models (GMM). In module 112, note classification results can be integrated to provide a musical piece classification result. The classification can be used for establishing metadata, represented as any information that can be used to index the musical piece for storage in the database based on the classification assigned to the musical piece. Similarly, the metadata can be used for retrieval of the musical piece from the database. In accordance with techniques of the present invention, the classification, indexing and retrieval can be performed in real time, thereby rendering exemplary embodiments suitable for online database management. Those skilled in the art will appreciate that the functions described herein can be combined in any desired manner in any number (e.g., one or more) modules, or can be implemented in non-modular fashion as a single integrated system of software and/or hardware components.

Figure 2:
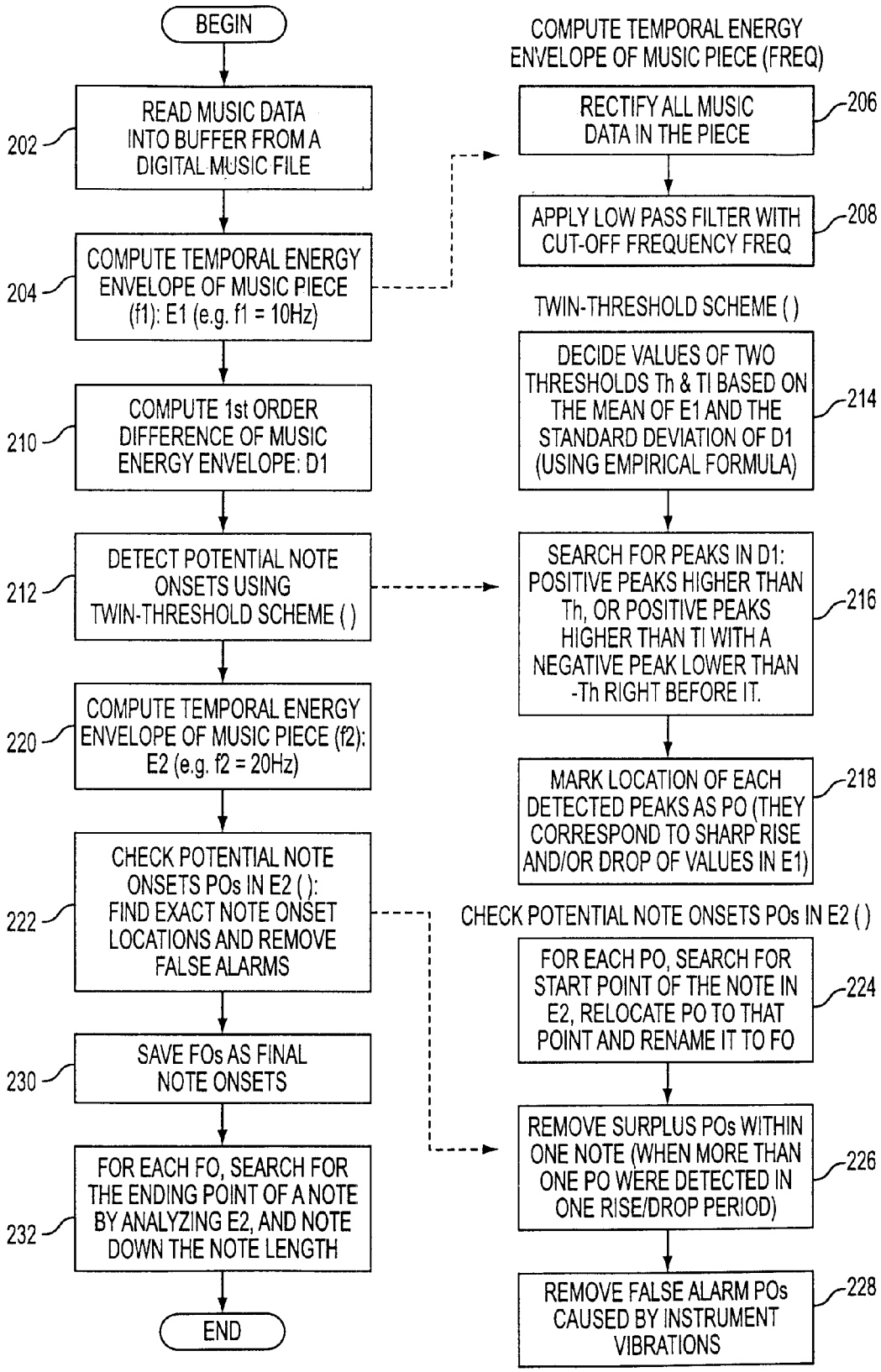
FIG. 2 shows a functional block diagram associated with a first module of the FIG. 1 exemplary embodiment.

FIG. 2 details exemplary steps associated with detecting an onset of each of the plural notes contained in a musical piece for purposes of segmenting the musical piece. The exemplary FIG. 2 method includes detecting an onset of each of plural notes contained in a portion of the musical piece using a temporal energy envelope, as represented by a sharp drop and/or rise in the energy value of the temporal energy envelope. Referring to FIG. 2, music data is read into a buffer from a digital music file in step 202. A temporal energy envelope E1 of the music piece, as obtained using a first cutoff frequency f1, is computed in step 204. For example, the musical piece can have an energy envelope on the order of 10 hertz or lesser or greater.

Computation of the temporal energy envelope includes steps of rectifying all music data in the music piece at step 206. A low pass filter with a cut off frequency "FREQ" is applied to the rectified music in step 208. Of course any filter can be used provided the desired temporal energy envelope can be discerned.

In step 210, a first order difference D1 of the temporal energy envelope E1 is computed. In exemplary embodiments, potential note onsets "POs" 212 can be distinguished using twin-thresholds in blocks 214, 216 and 218.

For example, in accordance with one exemplary twin-threshold scheme, values of two thresholds Th and T1 are determined based on, for example, a mean of the temporal energy envelope E1 and a standard deviation of the first order difference D1 using an empirical formula. In one example, only notes considered strong enough are detected, with weaker notes being ignored, because harmonic partial detection and harmonic partial parameter calculations to be performed downstream may be unreliable with respect to weaker notes. In an example, where Th and T1 are adaptively determined based on the mean of E1 and the standard deviation of D1, Th can be higher than T1 by a fixed ratio. For example:

$$Th = c1 * \text{mean}(E1) + c2 * \text{stnd}(D1)$$

$$T1 = Th * c3$$

where c1, c2 and c3 are constants (e.g.,: c1=1.23/2000; c2=1; c3=0.8, or any other desired constant values).

Those peaks in the first order difference of the temporal energy envelope which satisfy at least one of the following two criteria are searched: positive peaks higher than the first threshold Th, or positive peaks higher than the second threshold T1 with a negative peak lower than—Th just before it. Each detected peak is marked as a potential onset "PO". The potential onsets correspond, in exemplary embodiments, to a sharp rise and/or drop of values in the temporal energy envelope E1.

After having detected potential note onsets using the twin-threshold scheme, or any other number of thresholds (e.g., a single threshold, or greater than two thresholds), exact locations for note onsets are searched in a second temporal energy envelope of the music piece. Accordingly, in block 220, a second temporal energy envelope of the musical piece, as obtained using a second cutoff frequency f2, is computed as E2 (e.g., where the cutoff used to produce the envelope of the music piece is 20 hertz, or lesser or greater). In step 222, potential note onsets "POs" in E2 are identified. Exact note onset locations are identified and false alarms (such as energy rises or drops due to instrument vibrations) are removed.

The process of checking for potential note onsets in the second temporal energy envelope includes a step 224 wherein, for each potential note onset, the start point of the note in the temporal energy envelope E2 is searched. The potential onset is relocated to that point and renamed as a final note onset. In step 226, surplus potential note onsets are removed within one note, when more than one potential onset has been detected in a given rise/drop period. In step 228, false alarm potential onsets caused by instrument vibrations are removed.

In step 230, the final note onsets are saved. An ending point of a note is searched in step 232 by analyzing the temporal energy envelope E2, and the note length is recorded. The step of detecting an onset of each of plural notes contained in a portion of a musical piece can be used to segment the musical piece into notes.

Figure 3A:
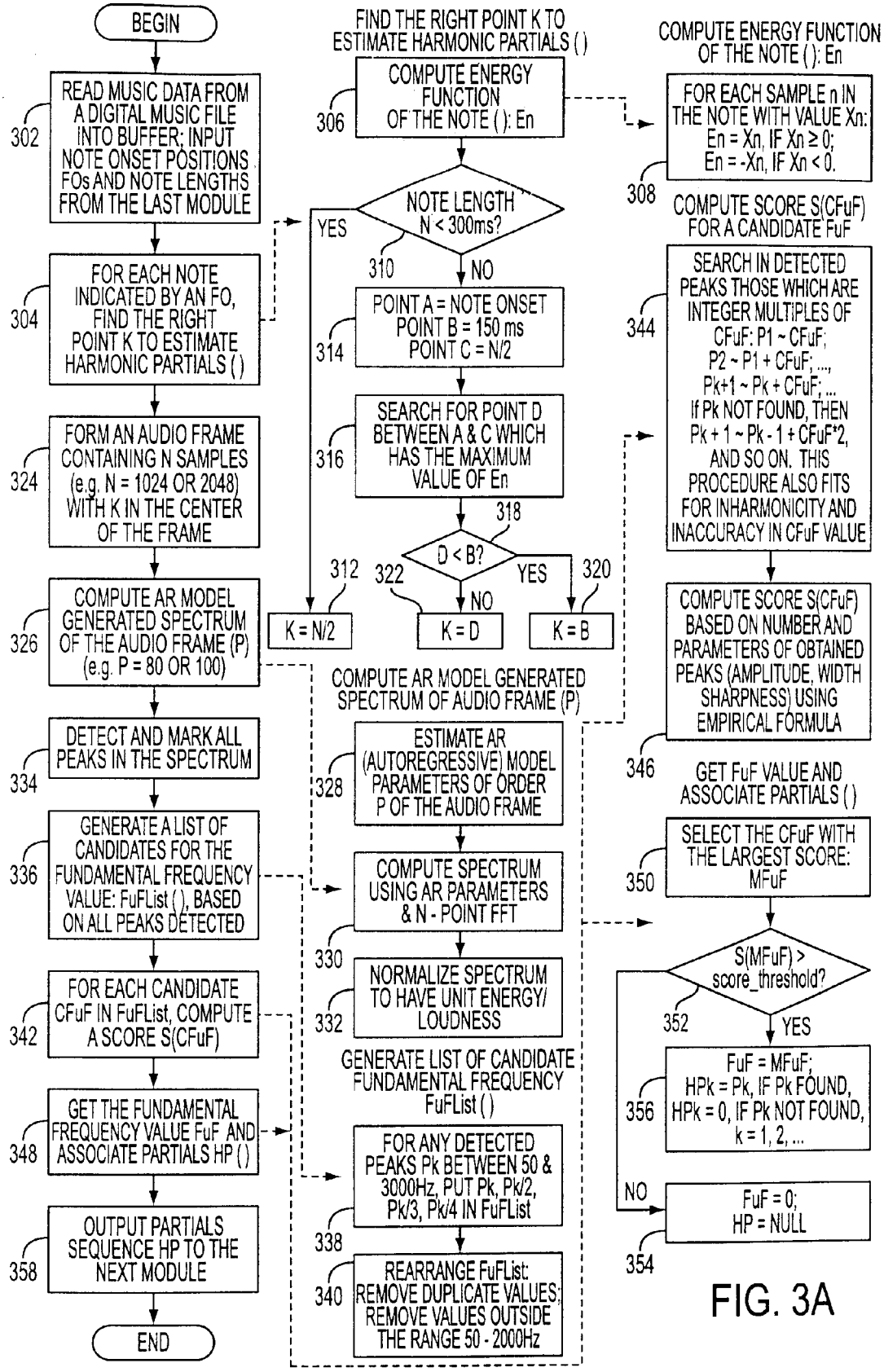
FIGS. 3A and 3B show a functional block diagram associated with a second module of the FIG. 1 exemplary embodiment.

FIG. 3A shows the determination of characteristics for each of the plural notes, and in particular, the module 104 detection of harmonic partials associated with each note. Harmonic partials are integer multiples of the fundamental frequency of a harmonic sound, and represented, for example, as peaks in the frequency domain. Referring to FIG. 3A, musical data can be read from a digital music file into a buffer in step 302. Note onset positions represented by final onsets FOs are input along with note lengths (i.e., the outputs of the module 102 of FIG. 1). In step 304, a right point K is identified to estimate harmonic partials associated with each note indicated by a final onset position.

To determine the point K suitable for estimating harmonic partials, an energy function is computed for each note in step 306. That is, for each sample n in the note with a value $X_n$, an energy function $E_n$ for the note is computed as follows:

$$E_n = X_n \text{ if } X_n \text{ is greater than or equal to } 0;$$

$$E_n = -X_n \text{ if } X_n \text{ is less than } 0.$$

as shown in block 308.

In decision block 310, the note length is determined. For example, it is determined whether the note length N is less than a predetermined time period such as 300 milliseconds or lesser or greater. If so, the point K is equal to N/2 as shown in block 312. Otherwise, as represented by block 314, point A is equal to the note onset, point B is equal to a predetermined period, such as 150 milliseconds, and point C is equal to N/2. In step 316, a search for point D between points A and C which has the maximum value of the energy function $E_n$ is conducted. In decision block 318, point D is compared against point B. If point D is less than point B, then K=B in step 320. Otherwise, K=D in step 322.

In step 324, an audio frame is formed which, in an exemplary embodiment, is centered about a point and contains N samples (e.g., N=1024, or 2048, or lesser, or greater), with "K" being in the center of the frame.

In step 326, an autoregressive (AR) model generated spectrum of the audio frame with order "P" is computed (for example, P is equal to 80 or 100 or any other desired number). The computation of the AR model generated spectrum is performed by estimating the autoregressive (AR) model parameters of order P of the audio frame in step 328.

The AR model parameters can be estimated through the Levinson-Durbin algorithm as described, for example, in N. Mohanty, "Random signals estimation and indentification—Analysis and Applications", Van Nostrand Reinhold Company, 1986. For example, an autocorrelation of an audio frame is first computed as a set of autocorrelation values R(k) after which AR model parameters are estimated from the autocorrelation values using the Levinson-Durbin algorithm. The spectrum is computed using the autoregressive parameters and an N-point fast Fourier transform (FFT) in step 330, where N is the length of the audio frame, and the logarithm of the square-root of the power spectrum values is taken. In step 332, the spectrum is normalized to provide unit energy/volume and loudness. The spectrum is a smoothed version of the frequency representation. In exemplary embodiments, the AR model is an all-pole expression, such that peaks are prominent in the spectrum. Although a directly computed spectrum can be used (e.g., produced by applying only one FFT directly on the audio frame), exemplary embodiments detect harmonic peaks in the AR model generated spectrum.

Having computed the AR model generated spectrum of the audio frame, all peaks in the spectrum are detected and marked in step 334. In step 336, a list of candidates for the fundamental frequency value for each note is generated as "FuFList( )", based on all peaks detected. For example, as represented by step 338, for any detected peaks "P" between 50 Hz and 3000 Hz, a P, P/2, P/3, P/4, and so forth, are placed in FuFList. In step 340, this list is rearranged to remove duplicate values. Values outside of the designated range (e.g., the range 50 Hz–2000 Hz) are removed.

In step 342, for each candidate CFuF in the list FuFList, a score labeled S(CFuF) is computed. For example, referring to step 344, a search is conducted to detect peaks which are integer multiples of each of the candidates CFuF in the list. As follows:

$P_1$~CFuF;

$P_2$~$P_1$+CFuF; . . .

$P_{k+1}$~$P_k$+CFuF; . . .

if $P_k$ not found, then $P_{k+1}$~$P_{k-1}$+CFuF*2 and so on.

This procedure can also accommodate notes with inharmonicity or inaccuracy in CFuF values.

In step 346, score S(CFuF) is computed based on the number and parameters of obtained peaks using an empirical formula. Generally speaking, a computed score can be based on the number of harmonic peaks detected, and parameters of each peak including, without limitation, amplitude, width and sharpness. For example, a first subscore for each peak can be computed as a weighted sum of amplitudes (e.g., two values, one to the left side of the peak and one to the right side of the peak), width and sharpness. The weights can be empirically determined. For width and/or sharpness, a maximum value can be specified as desired. When an actual value exceeds the maximum value, the actual value can be set to the maximum value to compute the subscore. Maximum values can also be selected empirically. A total score is then calculated as a sum of subscores.

Having computed the scores S(CFuf) of each candidate included in the list of potential fundamental frequency values for the note, the fundamental frequency value FuF and associated partial harmonics HP are selected in step 348. More particularly, referring to step 350, the scores for each candidate fundamental frequency value are compared and a score having a predetermined criteria (e.g., largest score, lowest score or any score fitting the desired criteria) is selected in step 350.

In decision block 352, the selected score S(MFuF) is compared against a score threshold. Assuming a largest score criterion is used, if the score is less than the threshold, then the fundamental frequency value FuF is equal to zero and the harmonics HP are designated as null in step 354.

Figure 3B:
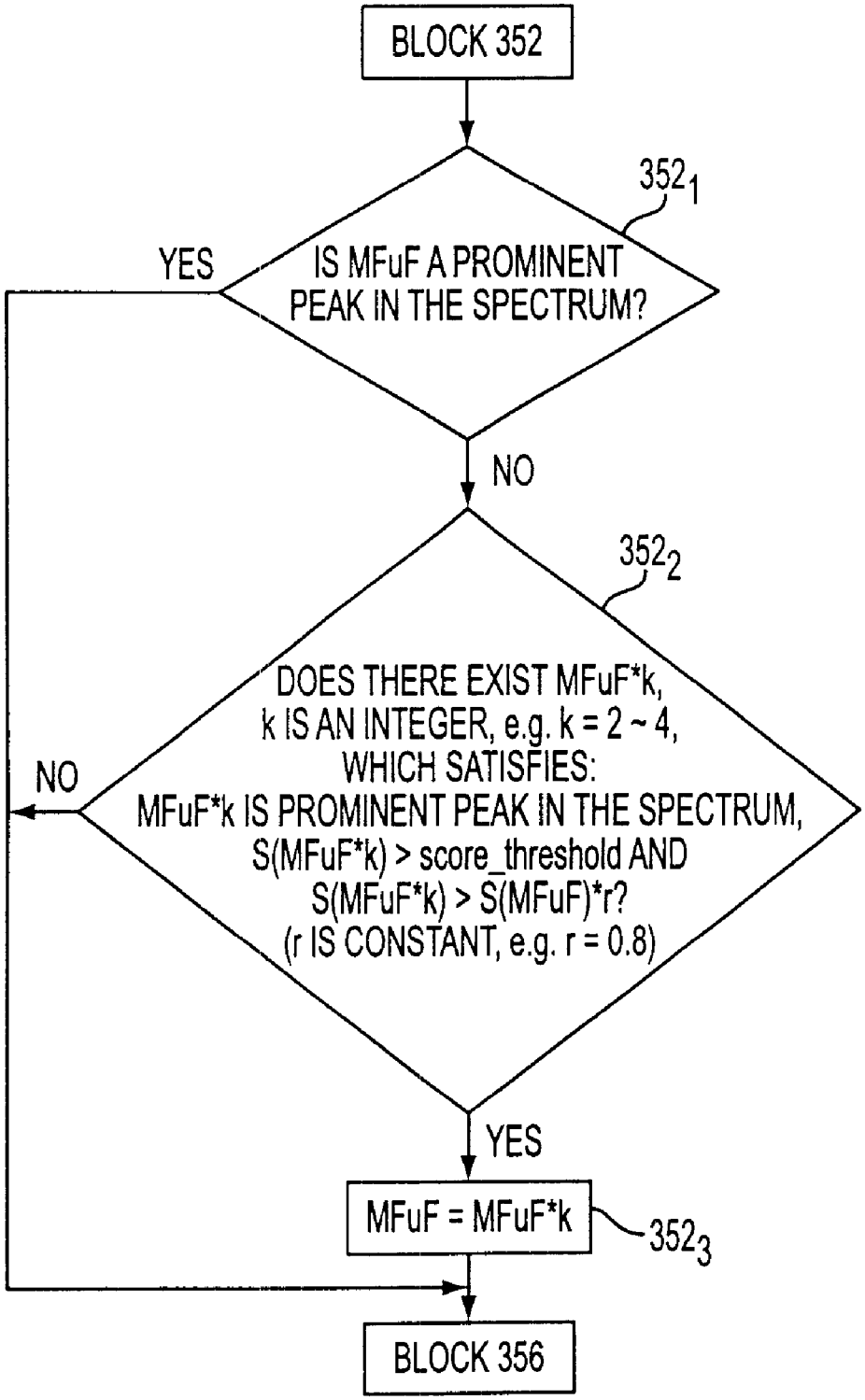

In step 356, the fundamental frequency value FuF is set to the candidate FuF (CFuF) value which satisfies the predetermined criteria (e.g., highest score). More particularly, referring to FIG. 3B, a decision that the score S (MFuF) is greater than the threshold results in a flow to block $\mathbf{352}_1$ wherein a determination is made as to whether MFuF is a prominent peak in the spectrum (e.g., exceeds a given threshold). If so, flow passes to block 356. Otherwise, flow passes to decision block $\mathbf{352}_2$ wherein a decision is made as to whether there is an existing MFuF*k (k being an integer, such as 2–4, or any other value) which satisfies the following: MFuF*k is prominent peak in the spectrum, S(MFuF*k) is greater than the score threshold, and S(MFuF*k) is>S (MFuF)*r (where "r" is a constant, such as 0.8 or any other value). If the condition of block $\mathbf{352}_2$ is not met, flow again passes to block 356. Otherwise, flow passes to block $\mathbf{352}_3$ wherein MFuF is set equal to MFuF*k.

Where flow passes to block 356, FuF is set equal to MFuF. Harmonic partials are also established. For example, in block 356, $HP_k=P_k$, if $P_k$ found; and $HP_k=0$ if $P_k$ is not found (where k=1,2, . . . ).

In step 358, the estimated harmonic partials sequence HP is output for use in determining additional characteristics of each note obtained in the musical piece.

This method of detecting harmonic partials works not only with clean music, but also with music with a noisy background; not only with monophonic music (only one instrument and one note at one time), but also with polyphonic music (e.g., two or more instruments played at the same time). Two or more instruments are often played at the same time (e.g., piano/violin, trumpet/organ) in musical performances. In the case of polyphonic music, the note with the strongest partials (which will have the highest score as computed in the flowchart of FIG. 3) will be detected.

Having described segmenting of the musical piece according to module 102 of FIG. 1 and the detection of harmonic partials according to module 104 of FIG. 1, attention will now be directed to the computation of temporal, spectral and partial features of each note according to module 106. Generally speaking, audio features of a note can be computed which are useful for timbre classification. Different instruments generate different timbres, such that instrument classification correlates to timbre classification (although a given instrument may generate multiple kinds of timbre depending on how it is played).

Figure 4:
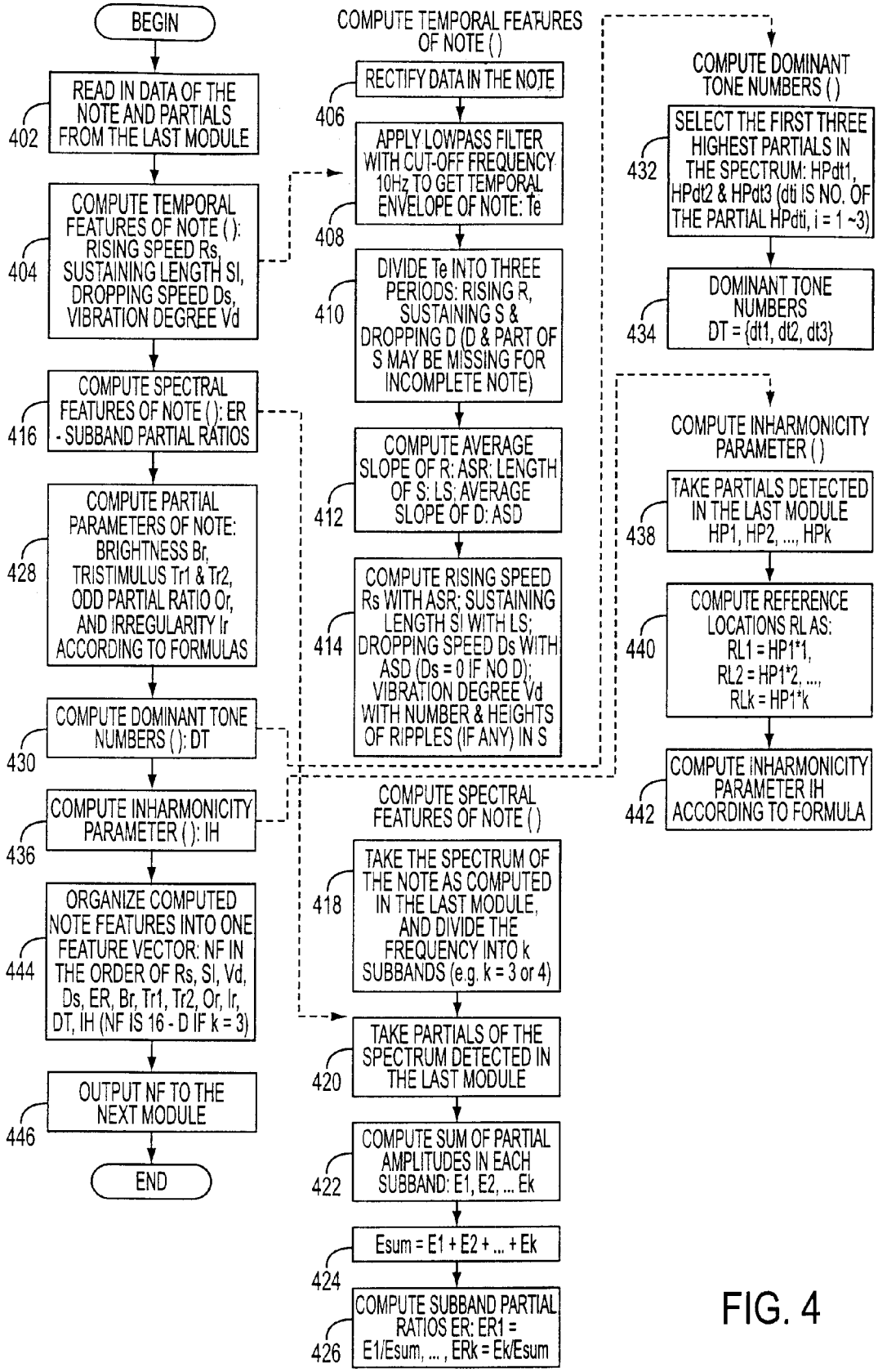
FIG. 4 shows a functional block diagram associated with a third module of the FIG. 1 exemplary embodiment.

Referring to FIG. 4, data of a given note and partials associated therewith are input from the module used to detect harmonic partials in each note, as represented by block 402. In step 404, temporal features of the note, such as the rising speed Rs, sustaining length Sl, dropping speed Ds, vibration degree Vd and so forth are computed.

More particularly, referring to step 406, the data contained within the note is rectified in step 406 and applied to a filter in step 408. For example, a low pass filter with a cutoff frequency can be used to distinguish the temporal envelope Te of the note. In an exemplary embodiment, the cutoff frequency can be 10 Hz or any other desired cutoff frequency.

In step 410, the temporal envelope Te is divided into three periods: a rising period R, a sustaining period S and a dropping period D. Those skilled in the art will appreciate that the dropping period D and part of the sustaining period may be missing for an incomplete note. In step 412, an average slope of the rising period R is computed as ASR (average slope rise). In addition, the length of the sustaining period is calculated as LS (length sustained), and the average slope of the dropping period D is calculated as ASD (average slope drop). In step 414, the rising speed Rs is computed with the average slope of the rising period ASR. The sustaining length Si is computed with the length of the sustaining period LS. The dropping speed Ds is computed with the average slope of the dropping period ASD, with the dropping speed being zero if there is no dropping period. The vibration degree Vd is computed using the number and heights of ripples (if any) in the sustaining period S.

In step 416, the spectral features of a note are computed as ER. These features are represented as subband partial ratios. More particularly, in step 418, the spectrum of a note as computed previously is frequency divided into a predetermined number "k" of subbands (for example, k can be 3, 4 or any desired number).

In step 420, the partials of the spectrum detected previously are obtained, and in step 422, the sum of partial amplitudes in each subband is computed. For example, the computed sum of partial amplitudes can be represented as E1 , E2, . . . Ek. The sum is represented in step 424 as Esum=E1+E2 . . . +Ek. In step 426, subband partial ratios ER are computed as: ER1=E1/Esum . . . , ERk=Ek/Esum. The ratios represent spectral energy distribution of sound among subbands. Those skilled in the art will appreciate that some instruments generate sounds with energy concentrated in lower subbands, while other instruments produce sound with energy roughly evenly distributed among lower, mid and higher subbands, and so forth.

In step 428, partial parameters of a note are computed, such as brightness Br, tristimulus $Tr_1$, and $Tr_2$, odd partial ratio Or (to detect the lack of energy in odd or even partials), and irregularity Ir (i.e., amplitude deviations between neighboring partials) according to the following formulas:

$$Br \sum_{k\ 1}^{N} k a_k \Big/ \sum_{k\ 1}^{N} a_k$$

N is number of partials.

$a_k$ is amplitude of the kth partial.

$$Tr1\ a_1 \Big/ \sum_{k\ 1}^{N} a_k$$

$$Tr2\ (a_2\quad a_3\quad a_4) \Big/ \sum_{k\ 1}^{N} a_k$$

-continued $$Or \sum_{k\ 1}^{N/2} a_{2k\ 1} \Big/ \sum_{k\ 1}^{N} a_k$$

$$Ir \sum_{k\ 1}^{N\ 1} (a_k\quad (a_{k\ 1}))^2 \Big/ \sum_{k\ 1}^{N\ 1} a_k 2$$

In this regard, reference is made to the aforementioned document entitled "Spectral Envelope Modeling" by Kristoffer Jensen, of Aug. 1998, which was incorporated by reference.

In step 430, dominant tone numbers DT are computed. In an exemplary embodiment, the dominant tones correspond to the strongest partials. Some instruments generate sounds with strong partials in low frequency bands, while others produce sounds with strong partials in mid or higher frequency bands, and so forth. As represented in 432, dominant tone numbers are computed by selecting the first three highest partials in the spectrum, represented as HPdt1, HPdt2 and HPdt3, where dti is the number of partial HPdti where i=1~3. In step 434, dominant tone numbers are designated DT={dt1, dt2, dt3}.

In step 436, an inharmonicity parameter IH is computed. Inharmonicity corresponds to the frequency deviation of partials. Some instruments, such as a piano, generate sound having partials that deviate from integer multiples of the fundamental frequencies FuF, and this parameter provides a measure of the degree of deviation. Referring to step 438, partials previously detected and represented as HP1, HP2, . . . , HPk are obtained. In step 440, reference locations RL are computed as:

$$RL1=HP1*1,\ RL2=HP1*2\ \ldots,\ RLk=HP1*k$$

The inharmonicity parameter IH is computed in step 442 according to the following formula:

for $i=2\sim N$ $$IHi\ \frac{\left(\frac{HPi}{RLi}\right)^2\ 1}{i^2\ 1}$$

end then $$IH\ \frac{\sum_{i\ 2}^{N} IHi}{N\ 1}$$

In step 444, computed note features are organized into a note feature vector NF. For example, the feature vector can be ordered as follows: Rs, Sl, Vd, Ds, ER, Br, Tr1, Tr2, Or, Ir, DT, IH, where the feature vector NF is 16-dimensional if k=3. In step 446, the feature vector NF is output as a representation of computed note features for a given note.

In accordance with exemplary embodiments of the present invention, the determination of characteristics for each of plural notes contained in the music piece can include normalizing at least some of the features as represented by block 108 of FIG. 1. The normalization of temporal features renders these features independent of note length and therefore adaptive to incomplete notes. The normalization of partial features renders these features independent of note pitch. Recall that note energy was normalized in module 104 of FIG. 1 (see FIG. 3). Normalization ensures that notes of the same instrument have similar feature values and will be classified to the same category regardless of loudness/volume, length and/or pitch of the note. In addition, incomplete notes which typically occur in, for example, polyphonic music, are addressed. In exemplary embodiments, the value ranges of different features are retained in the same order (e.g., between 0 and 10) for input to the FIG. 1 module 110, wherein classification occurs. In an exemplary embodiment, no feature is given a predefined higher weight than other features, although if desired, such predefined weight can, of course, be implemented. Normalization of note features will be described in greater detail with respect to FIG. 5.

Figure 5:
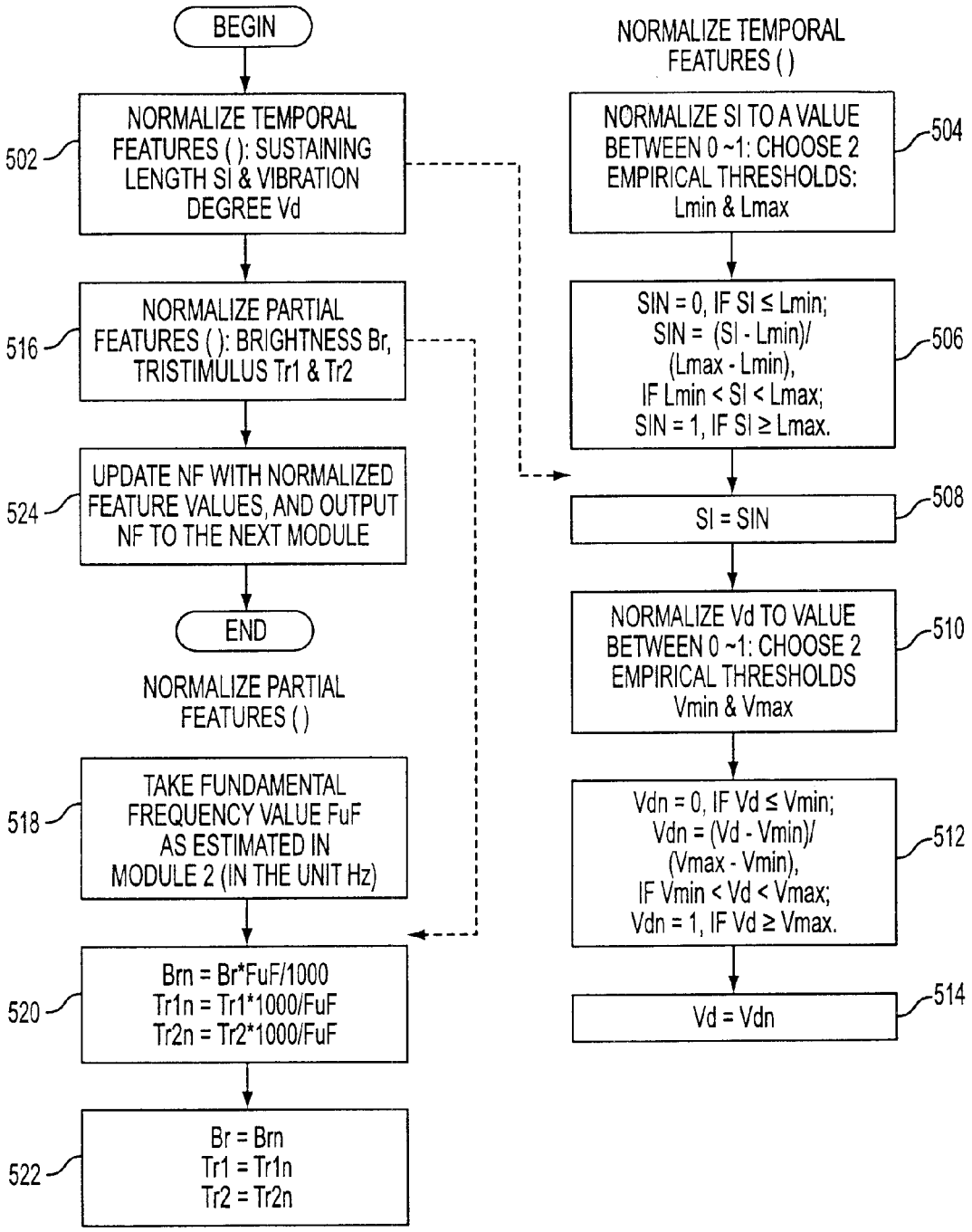
FIG. 5 shows a functional block diagram associated with a fourth module of the FIG. 1 exemplary embodiment.

Referring to FIG. 5, step 502 is directed to normalizing temporal features such as sustaining length Sl and vibration degree Vd. More particularly, referring to step 504, the sustaining length Sl is normalized to a value between 0~1. In exemplary embodiments, 2 empirical thresholds (Lmin and Lmax) can be chosen. The following logic is applied to the results of step 504 and in step 506:

Sln=0, if Sl<=Lmin;

Sln=(Sl−Lmin)/(Lmax−Lmin)

if Lmin<Sl<Lmax;

Sln=1, if Sl>=Lmax.

In step 508, the normalized sustaining length Sl is chosen as Sln.

Normalization of the vibration degree Vd will be described in greater detail with respect to step 510, wherein Vd is normalized to a value between 0~1 using two empirical thresholds Vmin and Vmax. Logic is applied to the vibration degree Vd according to step 512, as follows:

Vdn=0, if Vd<=Vmin;

Vdn=(Vd−Vmin)/(Vmax−Vmin)

if Vmin<Vd<Vmax;

Vdn=1, if Vd>=Vmax.

In step 514, the vibration degree Vd is set to the normalized value Vdn.

In step 516, harmonic partial features such as brightness Br and the tristimulus values Tr1 and Tr2 are normalized. More particularly, in step 518, the fundamental frequency value FuF as estimated in Hertz is obtained, and in step 520, the following computations are performed:

Brn=Br*FuF/1000

Trln=Trl*1000/FuF

Tr2n=Tr2*1000/FuF

In step 522, the brightness value Br is set to the normalized value Brn, and the tristimulus values Tr1 and Tr2 are set to normalized values Trl*n* and Tr2*n*.

In step 524, the feature vector NF is updated with normalized features values, and supplied as an output. The collection of all feature vector values constitutes a set of characteristics determined for each of plural notes contained in a musical piece being considered.

The feature vector, with some normalized note features, is supplied as the output of module 108 in FIG. 1, and is received by the module 110 of FIG. 1 for classifying the musical piece. The module 110 for classifying each note will be described in greater detail with respect to FIGS. 6A and 6B.

Figures 6A, 6B:
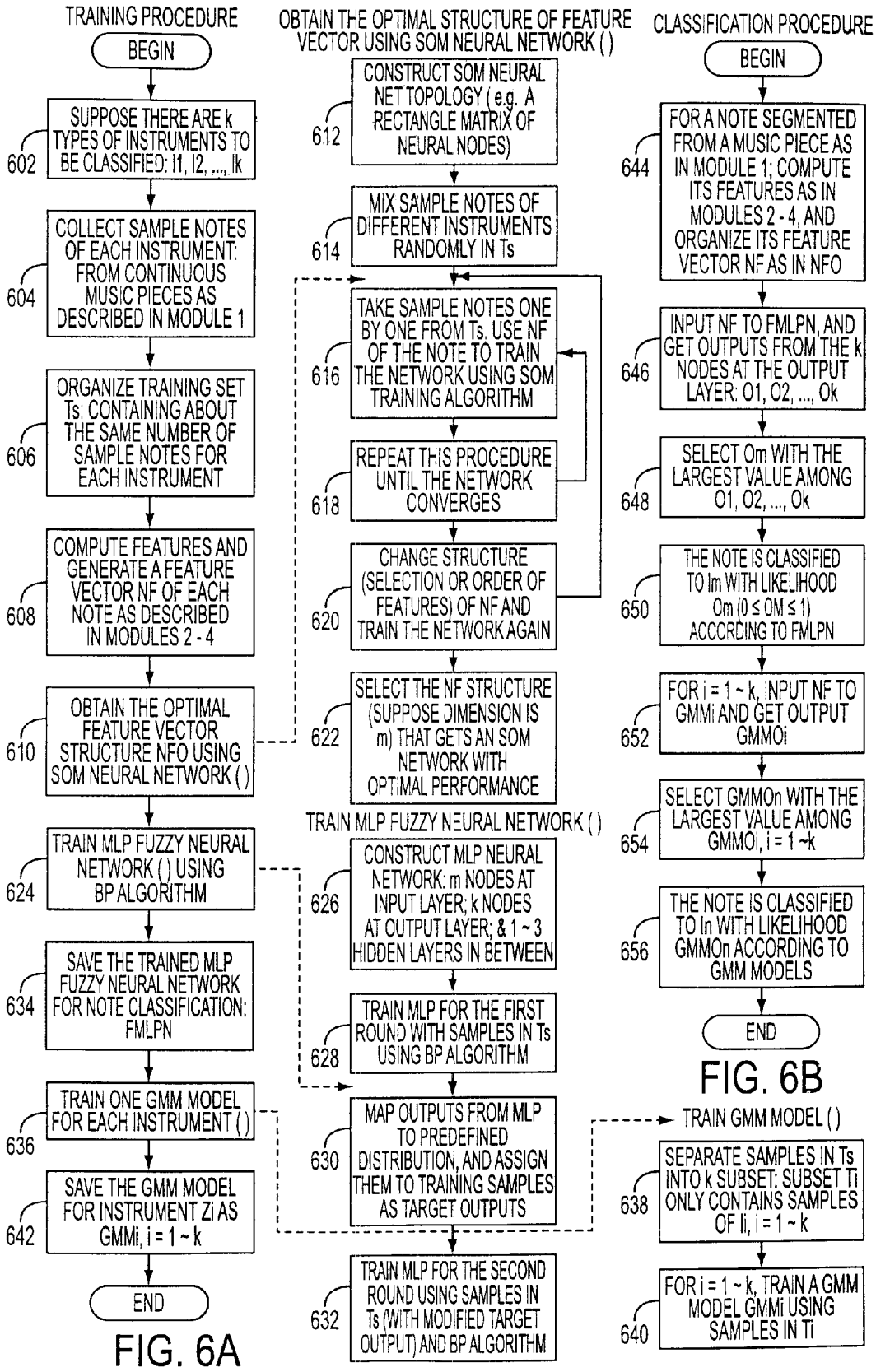
FIGS. 6A and 6B show a functional block diagram associated with a fifth module of the FIG. 1 exemplary embodiment.

Referring to FIG. 6A, a set of neural networks and Gaussian mixture models (GMM) are used to classify each detected note, the note classification process being trainable. For example, an exemplary training procedure is illustrated by the flowchart of FIG. 6A, which takes into consideration "k" different types of instruments to be classified, the instruments being labeled I1, I2, . . . Ik in step 602. In step 604, sample notes of each instrument are collected from continuous musical pieces. In step 606, a training set Ts is organized, which contains approximately the same number of sample notes for each instrument. However, those skilled in the art will appreciate that any number of sample notes can be associated with any given instrument.

In step 608, features are computed and a feature vector NF is generated in a manner as described previously with respect to FIGS. 3–5. In step 610, an optimal feature vector structure NFO is obtained using an unsupervised neural network, such as a self-organizing map (SOM), as described, for example, in the document "An Introduction To Neural Networks", by K. Gurney, the disclosure of which is hereby incorporated by reference. In such a neural network, a topological mapping of similarity is generated such that similar input values have corresponding nodes which are close to each other in a two-dimensional neural net field. In an exemplary embodiment, a goal for the overall training process is for each instrument to correspond with a region in the neural net field, with similar instruments (e.g., string instruments) corresponding to neighboring regions. A feature vector structure is determined using the SOM which best satisfies this goal, according to exemplary embodiments. However, those skilled in the art will appreciate that any criteria can be used to establish a feature vector structure in accordance with exemplary embodiments of the present invention.

Where a SOM neural network is used, a SOM neural network topology is constructed in step 612. For example, it can be constructed as a rectangular matrix of neural nodes. In step 614, sample notes of different instruments are randomly mixed in the training set Ts. In step 616, sample notes are taken one by one from the training set Ts, and the feature vector NF of the note is used to train the network using a SOM training algorithm.

As represented by step 618, this procedure is repeated until the network converges. Upon convergence, the structure (selection of features and their order in the feature vector) of the feature vector NF is changed in step 620, and the network is retrained as represented by the branch back to the input of step 616.

An algorithm for training an SOM neural network is provided in, for example, the document "Introduction To Neural Networks", by K. Gurney, UCL Press, 1997, the contents of which have been incorporated by reference in their entirety, or any desired training algorithm can be used. In step 622, the feature vector NF structure is selected (e.g., with dimension m) that provides an SOM network with optimal performance, or which satisfies any desired criteria.

Having obtained an optimal feature vector structure NFO in step 610, the flow of the FIG. 6A operation proceeds to step 624 wherein a supervised neural network, such as a multi-layer-perceptron (MLP) fuzzy neural network, is trained using, for example, a back-propagation (BP) algorithm. Such an algorithm is described, for example, in the aforementioned Gurney document.

The training of an MLP fuzzy neural network is described with respect to block 626, wherein an MLP neural network is constructed, having, for example, m nodes at the input layer; k nodes at the output layer; and 1–3 hidden layers in between. In step 628, the MLP is trained for the first round with samples in the training set Ts using the BP algorithm. In step 630, outputs from the MLP are mapped to a predefined distribution, and are assigned to training samples as target outputs. In step 632, the MLP is trained for multiple rounds (e.g., a second round) using samples in the training set Ts, but with modified target outputs, and the BP algorithm.

As described above, an exemplary MLP includes a number of nodes in the input layer which is equal to the dimension of the note feature vector, and the number of nodes at the output layer corresponds to the number of instrument classes. The number of hidden layers and the number of nodes of each hidden layer are chosen as a function of the complexity of the problem, in a manner similar to the selection of the size of the SOM matrix.

Those skilled in the art will appreciate that the exact characteristics of the SOM matrix and the MLP can be varied as desired, by the user. In addition, although a two-step training procedure was described with respect to the MLP, those skilled in the art will appreciate that any number of training steps can be included in any desired training procedure used. Where a two-step training procedure is used, the first round of training can be used to produce desired target outputs of training samples which originally have binary outputs. After the training process converges, actual outputs of training samples can be mapped to a predefined distribution (desired distribution defined by the user, such as a linear distribution in a certain range). The mapped outputs are used as target outputs of the training sample for the second round of training.

In step 634, the trained MLP fuzzy neural network is saved for note classification as "FMLPN". In step 636, one GMM model (or any desired number of models) is trained for each instrument.

The training of the GMM model for each instrument in step 636 can be performed, for example in a manner similar to that described in "Robust Text-Independent Speaker Identification Using Gaussian Mixture Models", by D. Reynolds and R. Rose, IEEE Transactions On Speech and Audio Processing, Vol. 3, No. 1, pages 72–83, 1985, the disclosure of which is hereby incorporated by reference in its entirety. For example, as represented in step 638, by separating samples in the training set Ts into k subsets, where subset Ti contains samples for the instrument Ii for i=1~k. In step 640, for i=1~k, a GMM model GMMi is trained using samples in the subset Ti. The GMM model for each instrument "Ii" is saved in step 642 as GMMi, where i=1~k. The training procedure is then complete. Those skilled in the art will appreciate that the GMM is a statistical model, representing a weighted sum of M component Gaussian densities, with M being selected as a function of the complexity of the problem.

Although the training algorithm can be an EM process as described, for example, in the aforementioned document "Robust Text-Independent Speaker Identification Using Gaussian Mixture Models", by D. Reynolds et al., any GMM training algorithm can be used. In addition, although a GMM can be trained for each instrument, multiple GMMs can be used for a single instrument, or a single GMM can be shared among multiple instruments, if desired.

Those skilled in the art will appreciate that the MLP provides a relatively strong classification ability but is relatively inflexible in that, according to an exemplary embodiment, each new instrument under consideration involves a retraining of the MLP for all instruments. In contrast, GMMs for different instruments are, for the most part, unrelated, such that only a particular GMM for a given instrument need be trained. The GMM can also be used for retrieval, when searching for musical pieces or notes which are similar to a given instrument or set of notes specified by the user. Those skilled in the art will appreciate that although both the MLP and GMM are used in an exemplary embodiment, either of these can be used independently of the other, and/or independently of the SOM.

A classification procedure shown in FIG. 6B begins with the computation of features of a segmented note for organization in a feature vector NF as in NFO, according to step 644. In step 646, the feature vector NF is input to the trained MLP fuzzy neural network for note classification (i.e., FMLPN), and outputs from the k nodes at the output layer are obtained as "O1, O2, . . . Ok".

In step 648, the output Om with a predetermined value (e.g., largest value) among the nodes output from step 646 is selected. In step 650, the note is classified to the instrument subset "Im" with the likelihood Om where: 0<=Om<=1 according to the trained MLP fuzzy neural network for note classification (i.e., FMLPN). For i=1~k, the feature vector NF is input to the GMM model "GMMi" to produce the output GMMOi in step 652. In step 654, the output GMMOn with a predetermined value (e.g., largest value among GMMOi for i=1~k) is selected. In step 656, the note is classified to the instrument In with the likelihood GMMOn according to the GMM module.

Figure 7:
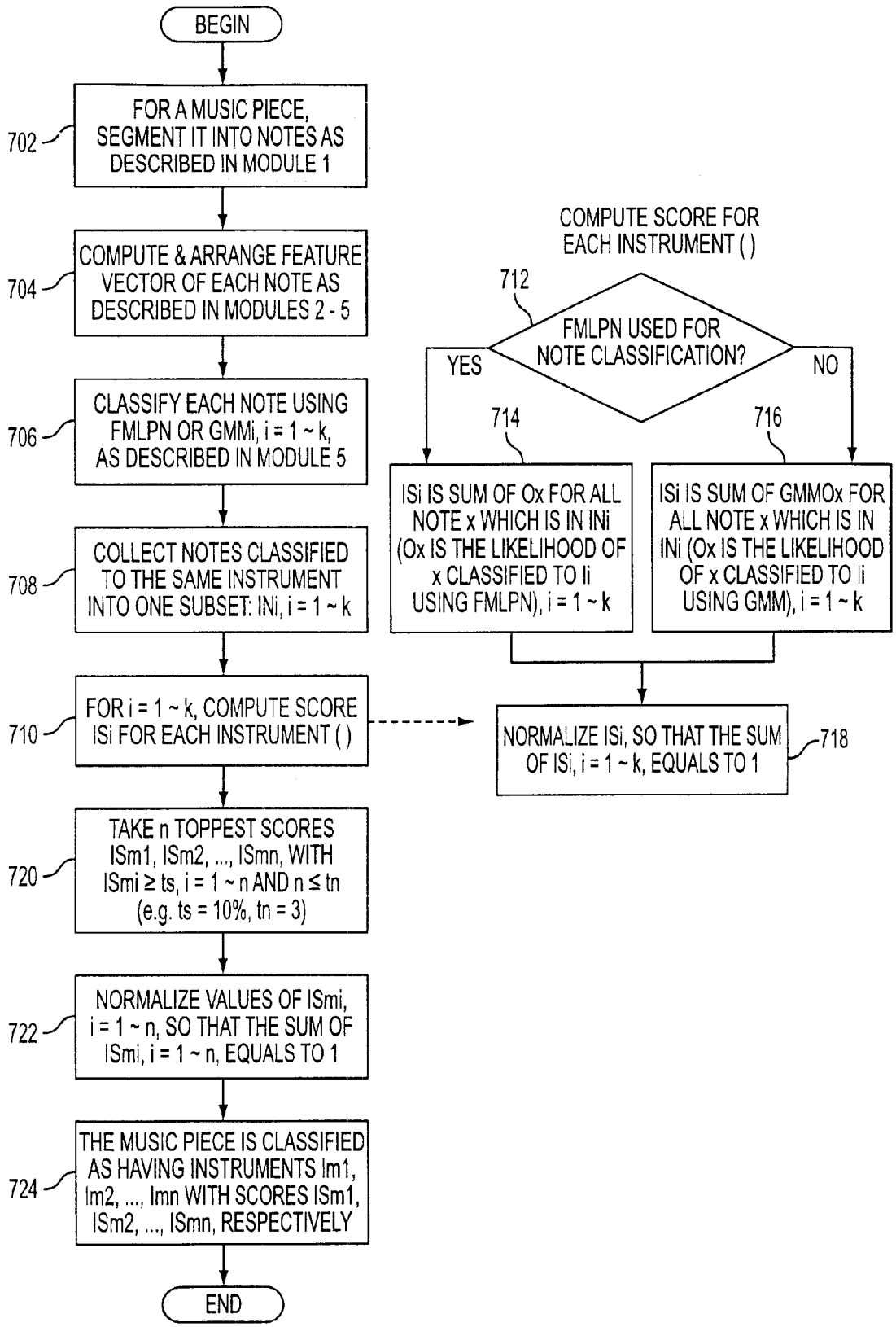
FIG. 7 shows a functional block diagram associated with a sixth module of the FIG. 1 exemplary embodiment.

In the FIG. 1 module 112, note classification results are integrated to provide the result of musical piece classification. This is shown in greater detail in FIG. 7, wherein a musical piece is initially segmented into notes according to step 102, as represented by step 702. In step 704, the feature vector is computed and arranged as described previously. In step 706, each note is classified using the MLP fuzzy neural network FMLPN or the Gaussian model GMMi, where i=1~k as described previously. In step 708, notes classified to the same instrument are collected into a subset for that instrument labeled INi, where i=1~k (step 708).

For i=1~k, the score labeled ISi is computed for each instrument in step 710. More particularly, in a decision block 712, a determination is made as to whether the MLP fuzzy neural network is used for note classification. If so, then in step 714, the score ISi is computed as the sum of outputs Ox from the k nodes at the output layer of the MLP fuzzy neural network FMLPN for all notes "x" in the instrument subset INi. Here, Ox is the likelihood of note x classified to instrument Ii using the MLP fuzzy neural network FMLPN where i=1~k. If the MLP fuzzy neural network was not used for neural classification, then the output of block 712 proceeds to step 716 wherein the score ISi corresponds to the sum of the Gaussian mixture model output GMMO represented as GMMOx for all notes x contained in the instrument subset INi. Here, Ox is the likelihood of x being classified to the instrument Ii using the Gaussian mixture model, with i=1~k. In step 718, the instrument score ISi is normalized so that the sum of ISi, where i=1~k, is equal to 1.

In step 720, the top scores ISm1, ISm2, . . . ISmn are identified for the conditions ISmi greater than or equal to ts, for i=1~n, and n less than or equal to tn (e.g., ts=10% or lesser or greater, and tn=3 or lesser or greater). In step 722, values of the top scores ISmi for i=1~n are normalized so that the sum of all ISmi, for i=1~n will total to 1. As with all criteria used in accordance with any calculation or assessment described herein, those skilled in the art can modify the criteria as desired.

In step 724, the musical piece is classified as having instruments Im1, Im2, . . . Imn with scores ISm1, ISm2, . . . , ISmn, respectively. Based on the classification, music related information such as musical pieces, or other types of information which include, at least in part, musical pieces containing a plurality of sounds, can be indexed with a metadata indicator, or tag, for easy index of the musical piece or music related information in a database.

The metadata indicator can be used to retrieve a musical piece or associated music related information from the database in real time. Exemplary embodiments integrate features of plural notes contained within a given musical piece to permit classification of the piece as a whole. As such, it becomes easier for a user to provide search requests to the interface for selecting a given musical piece having a known sequence of sounds and/or instruments. For example, musical pieces can be classified according to a score representing a sum of the likelihood values of notes classified to a specified instrument. Instruments with the highest scores can be selected, and musical pieces classified according to these instruments. In one example, a musical piece can be designated as being either 100% guitar, with 90% likelihood, or 60% piano and 40% violin.

Thus, exemplary embodiments can integrate the features of all notes of a given musical piece, such that the musical piece can be classified as a whole. This provides the user the ability to distinguish a musical piece in the database more readily than by considering individual notes.

While the invention has been described in detail with reference to the preferred embodiments thereof, it will be apparent to one skilled in the art that various changes and modifications can be made and equivalents employed, without departing from the present invention.

What is claimed is:

1. Method of classifying a musical piece, constituted by a collection of sounds, comprising the steps of:

detecting an onset of each of plural notes contained in a portion of the musical piece using a temporal energy envelope;

determining characteristics for each of the plural notes; and classifying a musical piece for storage in a database based on integration of determined characteristics for each of the plural notes.

2. Method of claim 1, comprising the step of:

segmenting the musical piece into notes using the onset of each note.

3. Method of claim 1, comprising the step of:

detecting potential note onsets using a twin-threshold.

4. Method of claim 1, comprising the step of:

checking potential note onsets and determining note length using an additional temporal energy envelope.

5. Method of claim 1, wherein the step of determining characteristics comprises:

detecting harmonic partials of a note.

6. Method according to claim 5, wherein the step of determining harmonic partials of a note comprises:

computing an energy function for the note.

7. Method of claim 5, wherein the step of determining harmonic partials of a note comprises:

determining at least one point within at least one note for estimating the harmonic partials;

forming an audio frame for the at least one note which is centered about the at least one point and which contains multiple samples;

computing an autoregressive model generated spectrum of the audio frame; and generating a list of candidates as a fundamental frequency value for the at least one note based on detected peaks in the generated spectrum of the audio frame.

8. Method according to claim 7, further comprising the step of:

computing a score for each candidate in the list; and selecting a fundamental frequency value and associated partials for the at least one note based on comparison of scores for that fundamental frequency value.

9. Method according to claim 1, wherein the step of determining characteristics for each note, comprises a step of:

computing temporal features for each note.

10. Method according to claim 9, wherein the temporal features for at least one note include vibration degree of the at least one note.

11. Method according to claim 1, wherein the step of determining characteristics for each note, comprises a step of:

computing spectral features for each note.

12. Method according to claim 9, wherein the step of determining characteristics for each note, comprises a step of:

computing spectral features for each note.

13. Method according to claim 12, comprising a step of:

computing dominant tone numbers for each note using harmonic partials detected for the note.

14. Method of claim 13, comprising the step of:

computing an inharmonicity parameter for each note based on detected harmonic partials for the note.

15. Method of claim 12, comprising the step of:

organizing computed note features for each note into a feature vector.

16. Method of claim 1, wherein said step of determining characteristics for each note further comprises a step of:

normalizing at least one feature for each note.

17. Method of claim 12, wherein said step of determining characteristics for each note further comprises a step of:

normalizing at least one feature for each note.

18. Method of claim 1, wherein the step of classifying comprises a step of:

producing a feature vector structure for processing feature vectors associated with each note using a neural network.

19. Method of claim 18, wherein the feature vector structure is trainable.

20. Method of claim 1, wherein the step of classifying comprises a step of:

training a multi-layer-perceptron fuzzy neural network using multiple rounds of a back-propagation algorithm.

21. Method of claim 1, wherein the step of classifying comprises a step of:

training a Gaussian Mixture Model for each instrument.

22. Method of claim 1, comprising a step of:

indexing the musical piece with metadata for storage in a database.

* * * * *